US006050590A

United States Patent [19]

Domon

[11] Patent Number: 6,050,590

[45] Date of Patent: Apr. 18, 2000

[54] SELF-COUPLING SNOWBOARD BINDING AND FOOTWEAR THEREFOR

[76] Inventor: Gerard Domon, Mandataire, Av. Weck Reynold 13, Fribourg, Switzerland

[21] Appl. No.: 09/091,512

[22] PCT Filed: Dec. 18, 1996

[86] PCT No.: PCT/IB96/01447

§ 371 Date: Apr. 5, 1999

§ 102(e) Date: Apr. 5, 1999

[87] PCT Pub. No.: WO97/22390

PCT Pub. Date: Jun. 26, 1997

[51] Int. Cl.[7] ..... A63C 9/20

[52] U.S. Cl. ..... 280/630

[58] Field of Search ..... 280/14.2, 624, 280/625, 617, 634; 441/70; 36/115, 117.1, 117.2, 117.3, 117.7

[56] References Cited

U.S. PATENT DOCUMENTS

| | | | |
|---|---|---|---|
| 3,891,227 | 6/1975 | Spademan | 280/624 |
| 3,905,613 | 9/1975 | Romeo | 280/623 |
| 4,392,666 | 7/1983 | Ramer | 280/614 |
| 4,403,789 | 9/1983 | Hickey | 280/614 |
| 4,959,913 | 10/1990 | Provence et al. | 37/117.2 |
| 5,558,355 | 9/1996 | Henry | 280/624 |
| 5,577,757 | 11/1996 | Riepl et al. | 280/624 |
| 5,697,631 | 12/1997 | Ratzek et al. | 280/613 |
| 5,875,566 | 3/1999 | Bourdeau et al. | 36/12 |

FOREIGN PATENT DOCUMENTS 9509035 4/1995 WIPO .

*Primary Examiner*—Brian L. Johnson
*Assistant Examiner*—Michael Britton
*Attorney, Agent, or Firm*—Liniak, Berenato, Longacre & White

[57] ABSTRACT

A booting device allows quick booting-up without any prior adjustment. The booting device includes a substantially oblong foundation (1) to be affixed to the board. The foundation is fitted with two plates (3; 4) vertically fastened to its two large sides. The two plates are fitted at their centers with two slots (6; 7) receiving and keeping in place a bar affixed to the boot's sole. Said bar (10) is biased into the grooves by self-tightening cams (8; 9). A lever (12) spring-loaded into a specified position allows moving the cams in order to release the bar (10).

10 Claims, 7 Drawing Sheets

Figure 1:
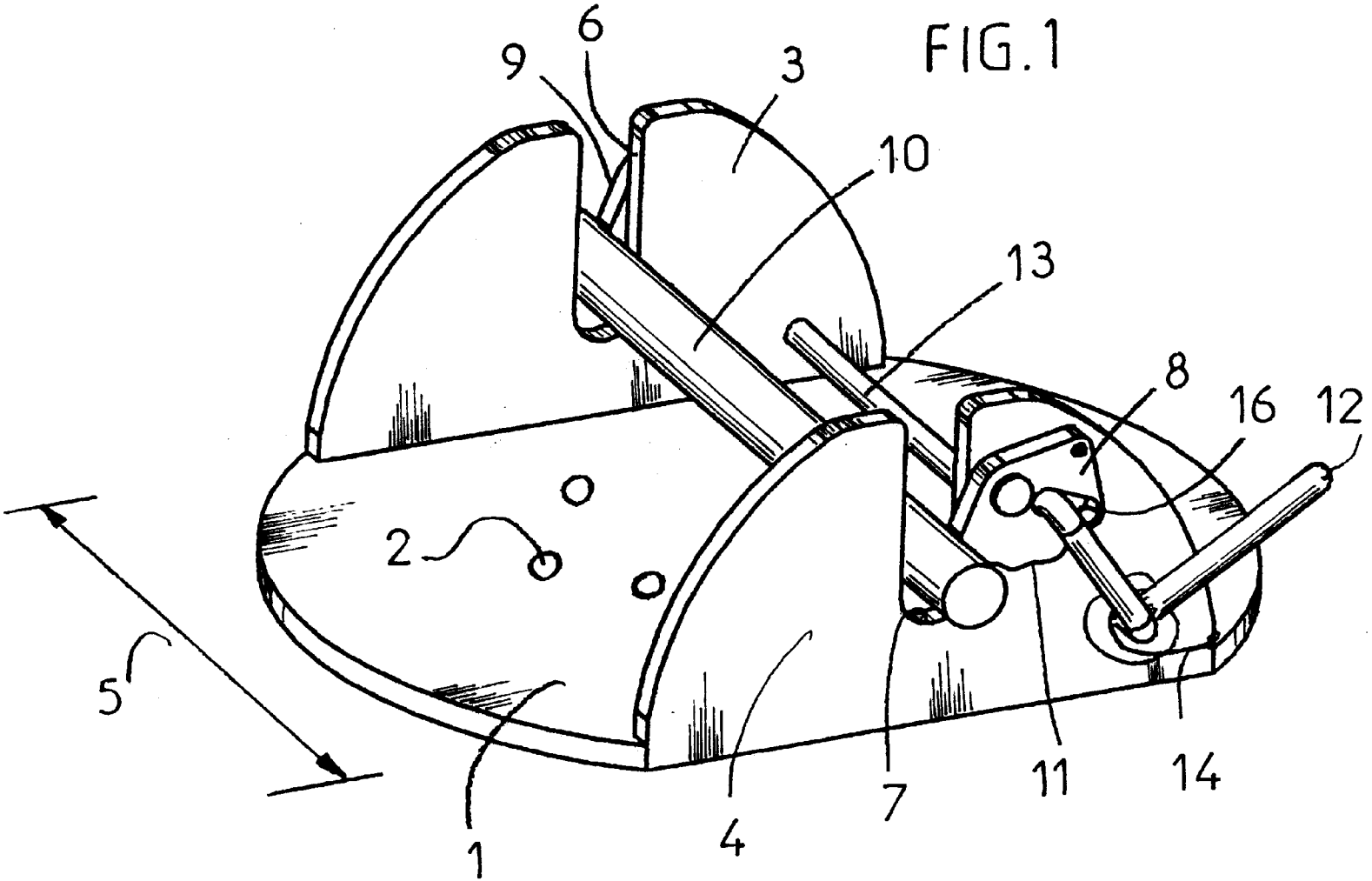

15
10
8
13
4
12
1
7

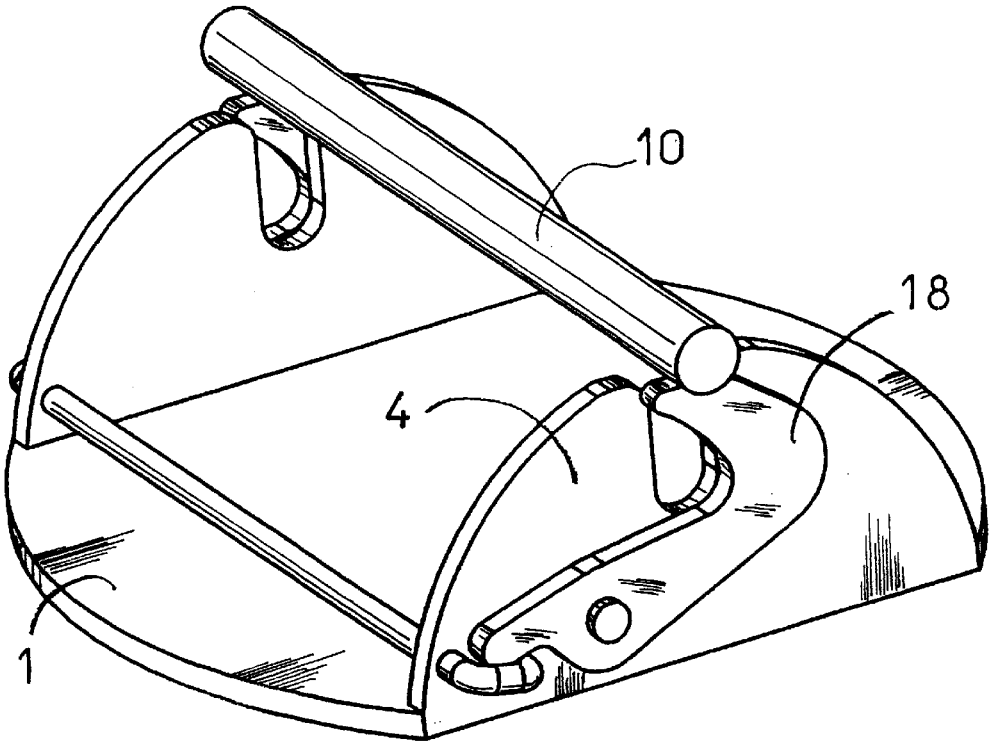
FIG.7
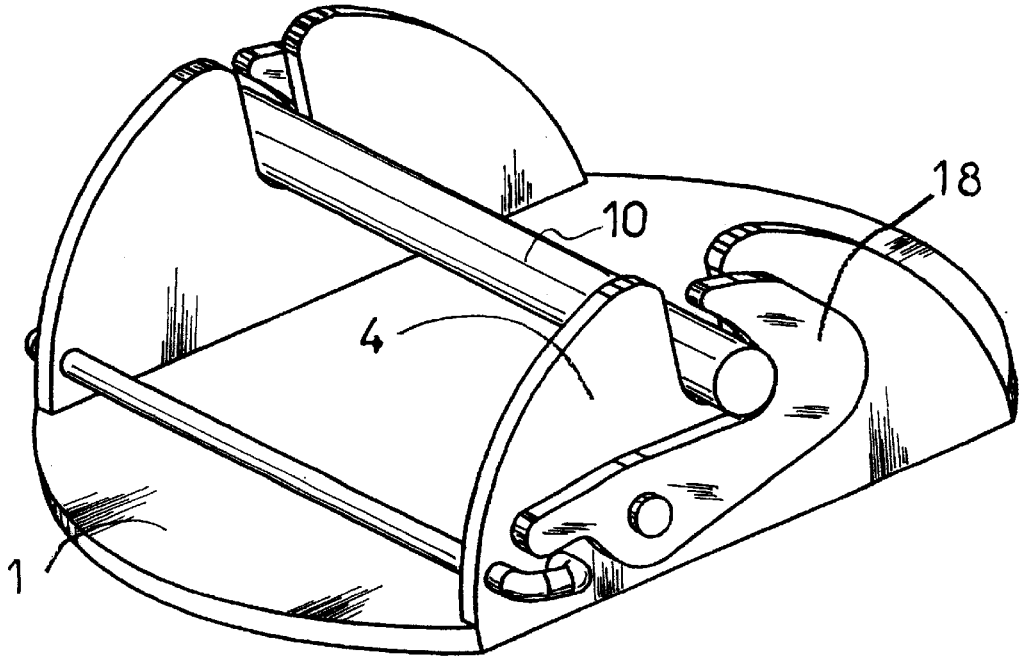

SELF-COUPLING SNOWBOARD BINDING AND FOOTWEAR THEREFOR

The objective of the invention is an automatic booting device for a snow surfboard and a boot for this board. The snow surfboard, also called snowboard, is a varyingly flexible elongated board designed to slide on snow.

Compared to the time in service, the snowboards are expensive. Moreover they take up substantial space when not in use. Accordingly many casual sports people prefer renting snowboards to purchasing them. Present booting devices require adjustment depending on boot type and size. Currently commercially available automatic snowboard booting devices offer few booting positions, entailing inconvenience, especially with the so-called alpine, rigid-shell boots.

In fact present automatic booting devices are fitted with a highly directional latching mechanism. Most booting devices for automatic booting boards require the user to apply high accuracy in booting up. These booting devices are unsatisfactory because some are off center relative to the boot and require a yoke at the boot front. They do not spread the stresses well over the board. They engage sideways, or in highly directional manner, with discomfort to the user. Moreover they cannot be used with so-called shell, rigid boots. Regarding other types, the position during engagement masks the booting device from the user and demands high accuracy. These booting devices lack the ability to automatically adjust tightening when snow accumulates under the boot. Because the snow is tamped by user motion, a void is left, leading to instabilities.

Proposals have been advanced to improve the automatic board booting devices by fitting them with a base comprising lateral hooks of which one is locked by a lever and into which will snap two yokes solidly joined to the boot. One of the yokes is locked by a closing means allowing passage when booting-up but preventing yoke return by blocking the way in the case of vertical force. While such a booting device is satisfactory as regards automatic booting, on the other hand it is inconvenient because booting must be implemented very directionally. As regards shell boots, this kind of booting device precludes using a rigid boot because, with the user's articulations being held in place, his/her leg lacks the required pliancy to allow device engagement. Another kind of booting device comprises a lower plate fastened to the board, the female base rigidly joined to the boot being fitted with the closing means, and while this design offers the feature of automatic board booting, it does however incur the drawback of masking the part to be engaged because being located under the user's boot.

Snowboard boots already are known which comprise flanges at their two ends or complex parts under the sole to hold them in place on the board or the ski. Most of these boots are user friendly, however they raise problems in some cases as regards affixation to the board or ski, in particular when snow has aggregated on the board or the ski or under the boot, in particular as regards boots affixed underneath their soles. Moreover, as regards the boots affixed at the front and rear or at the sides in cantilever manner, force transmission is less than optimal.

Other boots comprise recesses in the boot's middle zone to allow holding them by means of claws. These booting devices are comparatively complex and of low reliability. Moreover these boot recesses may fill with snow or the booting device may be covered by it, making booting-up difficult.

The objective of the invention is to create a booting device free of the drawbacks of the present ones and a boot for such a booting device. These goals are attained by the snowboard booting device defined in claim 1 and by the boot defined in claim 5.

The invention is elucidated in the following description of illustrative embodiments of the invention and in relation to the drawings.

Figure 2:
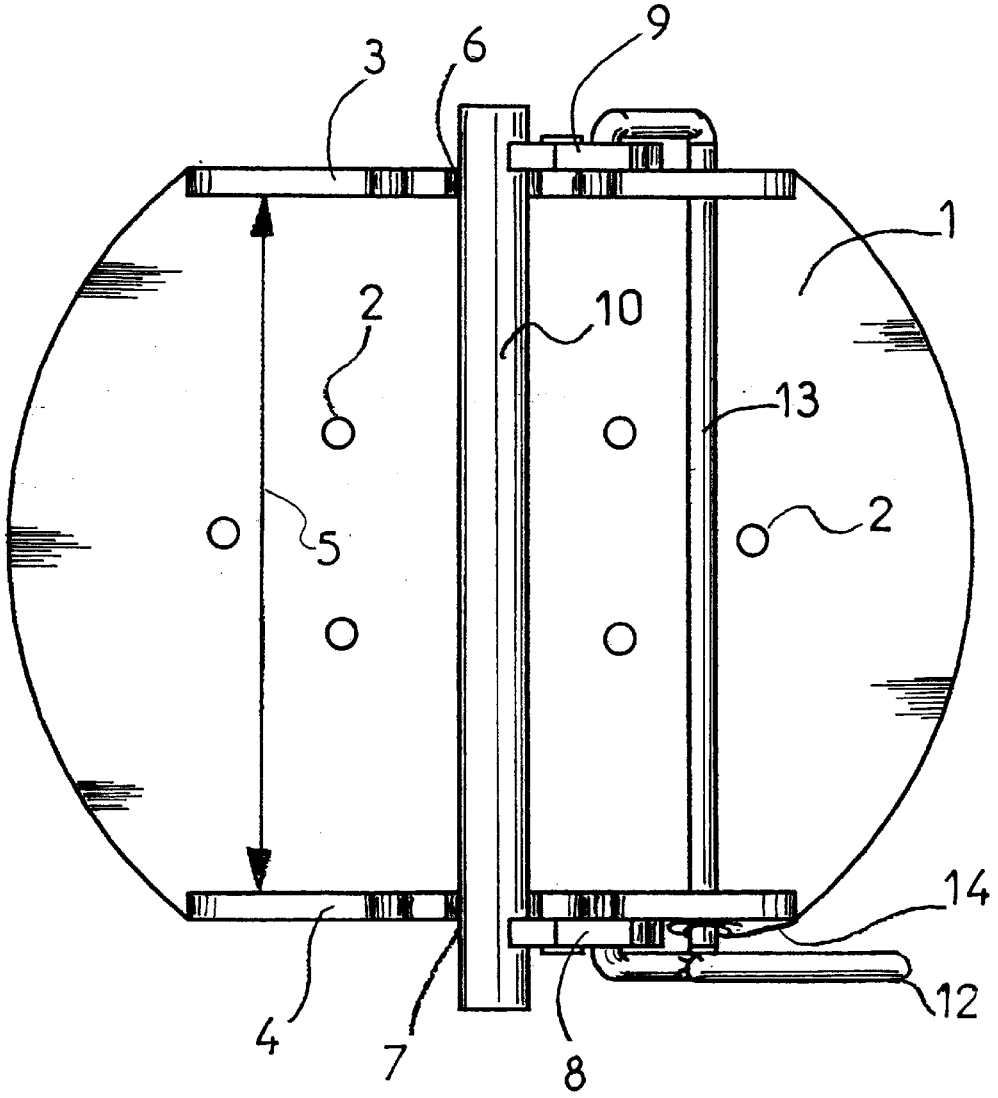
Figure 3:
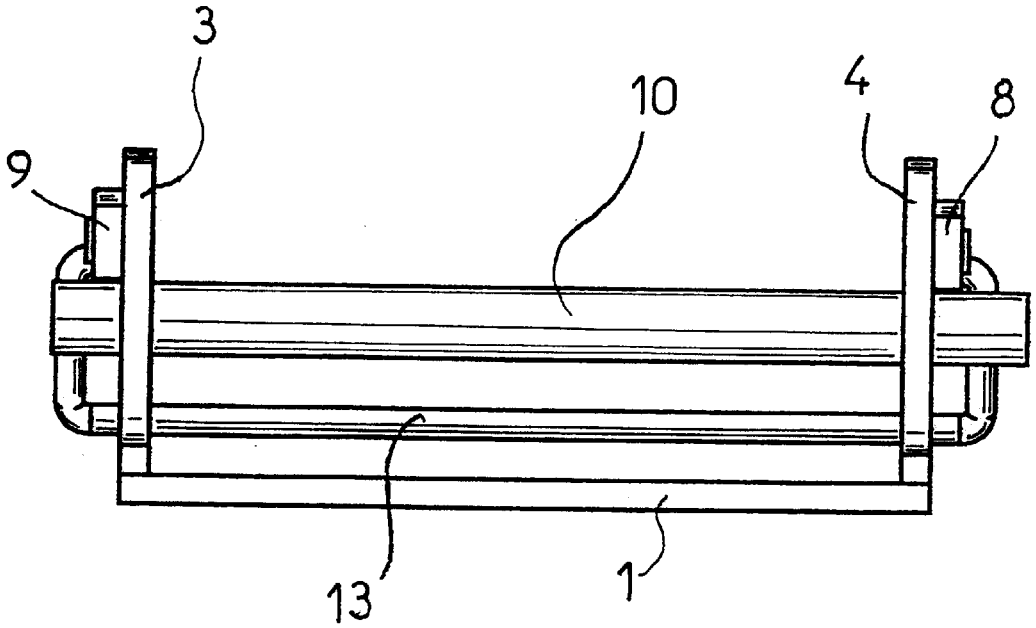
Figure 4:
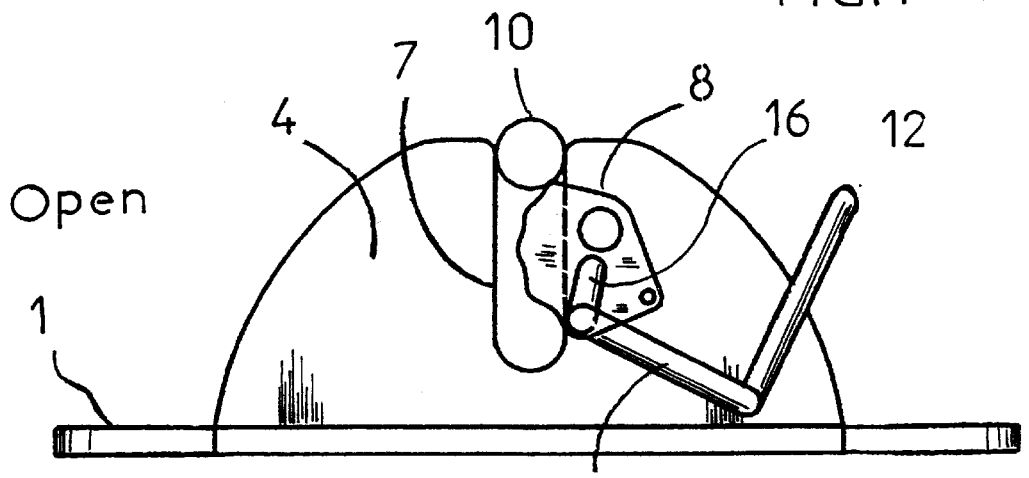
Figure 4:
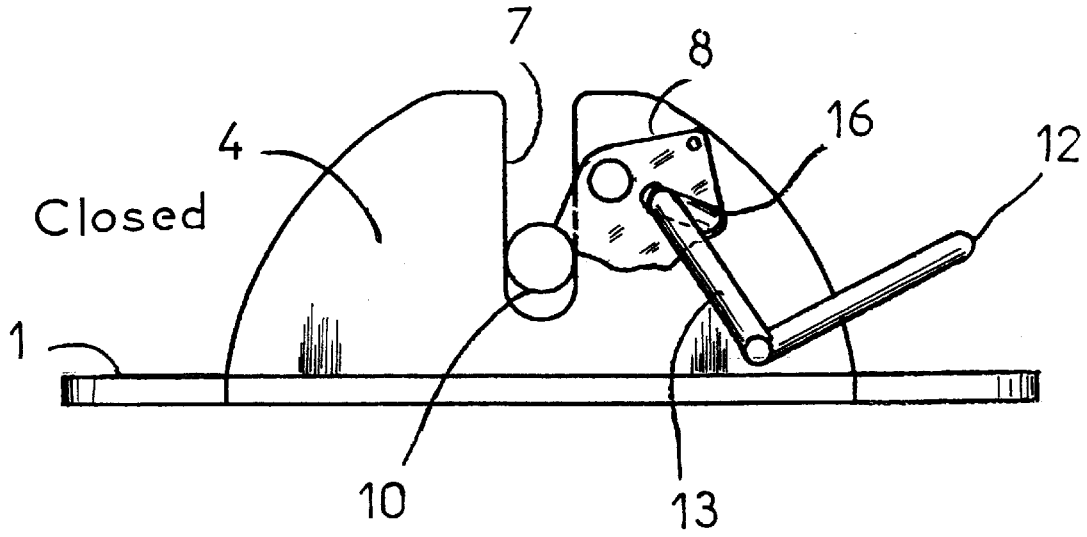
Figure 6:
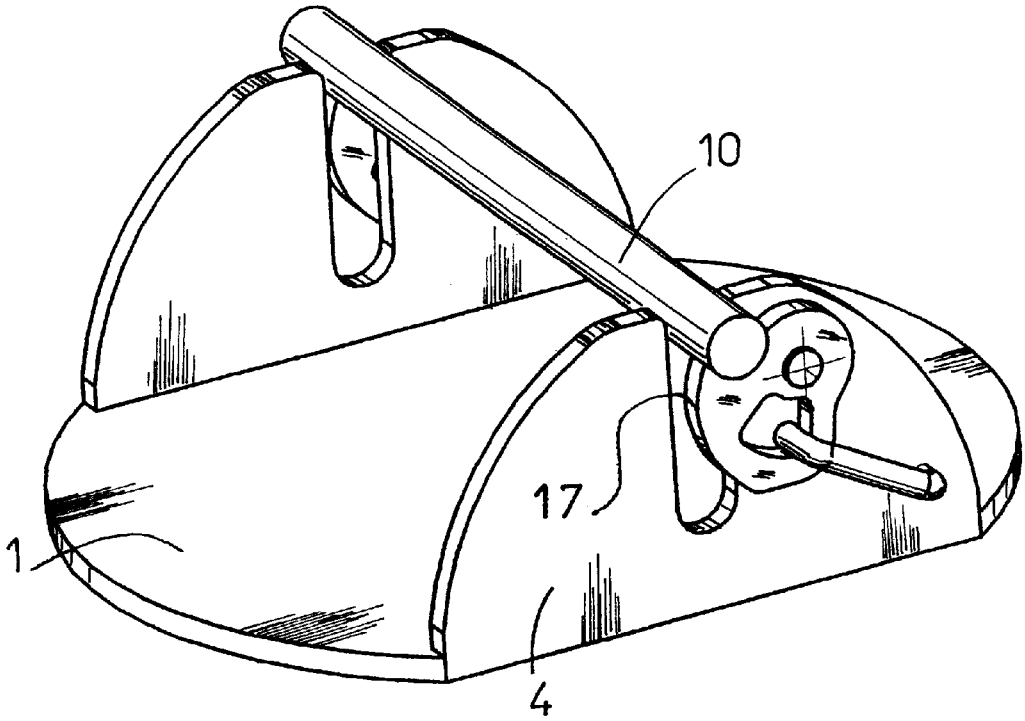
Figure 6:
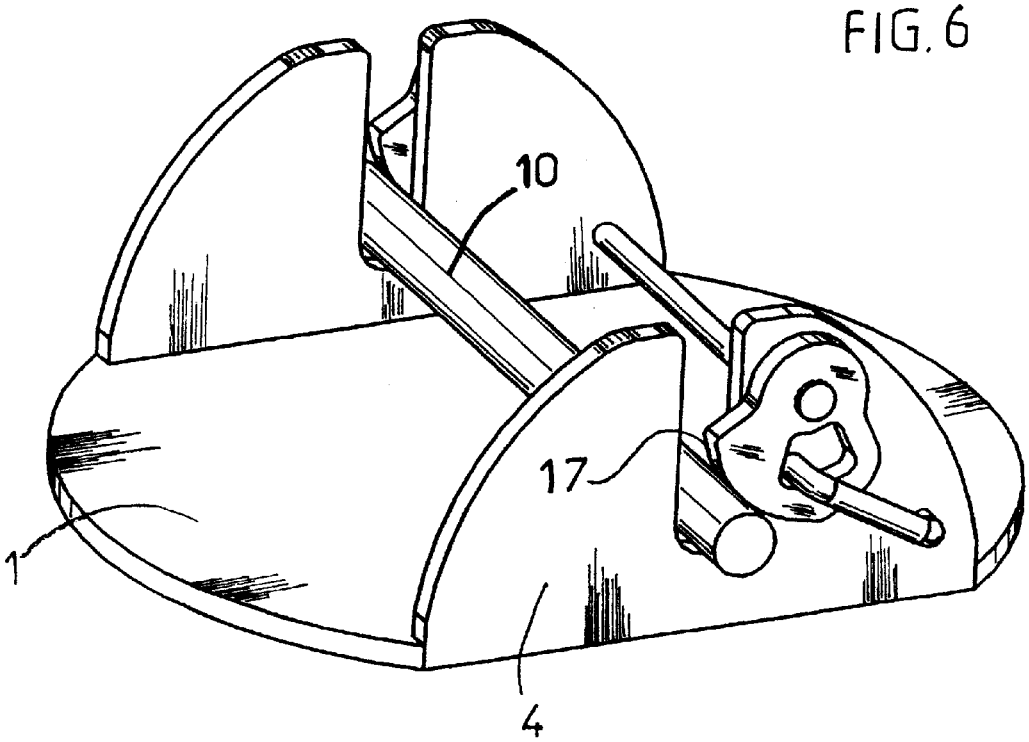

FIG. 1 is a perspective of one embodiment of the board booting-device of the invention, FIG. 2 is a topview of the booting device of FIG. 1, FIG. 3 is a front view of the booting device of FIG. 1, FIGS. 4*a* and 4*b* show two sideviews of the booting device of FIG. 1, namely in the open and closed positions, FIGS. 6A, 6B show an embodiment variation of the booting device of FIG. 1, resp. before and after booting-up, FIGS. 7A, 7B show another embodiment variation of the booting device of FIG. 1, resp. before and after booting-up, FIG. 8 is an underside perspective of the sole of a boot of the invention, and FIG. 9 is an exploded perspective of the sole of the boot of FIG. 9.

As shown in FIG. 1, a booting device of the invention is a compact sub-assembly of pleasant appearance. The booting device comprises a base plate 1, also called foundation, which shall be fastened to the upper surface of a snowboard. The foundation 1 is affixed by a screw passing through boreholes 2 or by means of an omitted disk fitted with notches to allowing angular adjustment over the range of 360° and with boreholes to receive the fastening screws (omitted). The omitted disk is independent of the foundation 1 and comprises a flange having flutings. Similar flutings are present in the foundation 1 to allow orienting the booting device in the desired manner. This device is known and used in present-day booting devices and therefore is not shown.

The booting device consists of a foundation 1 comprising two side plates 3 and 4 apart by a distance 5 substantially equal to the boot width. Each of said plates 3 and 4 is fitted with a vertical slot 6 and 7 resp. at its center and with a cam 8 and 9 resp. moving on shafts firmly joined to said plates 3 and 4. These cams shall keep a transverse bar 10 affixed underneath the boot sole (FIGS. 8 and 9) and at the bottom of the slots 6 and 7. The transverse bar 10 snaps into the slots 6 and 7 of the plates 3 and 4 of the foundation 1 and is kept in place by the cams 8 and 9. These cams are self-frightening, that is they can catch up with any play left by a layer of snow being tamped underneath the sole by means of the countersinks 11. The boot is released merely by pushing on a side lever 12 which, by means of a transmission rod 13 kept by a spring 14 in the low position simultaneously opens the two cams 8 and 9, allowing to withdraw the bar 10 and hence the boot 15 (FIG. 5).

The bar 10 may be straight or comprise a bend or bends.

FIG. 2 shows that the foundation 1 is compact and takes up only little space of the board. It also shows the transmission rod 13 controlling the opening of the cams 8 and 9. In the closed position, the bar 10 is shown held in place by the cams 8 and 9, in this manner a simple locking means being provided.

Figure 5:
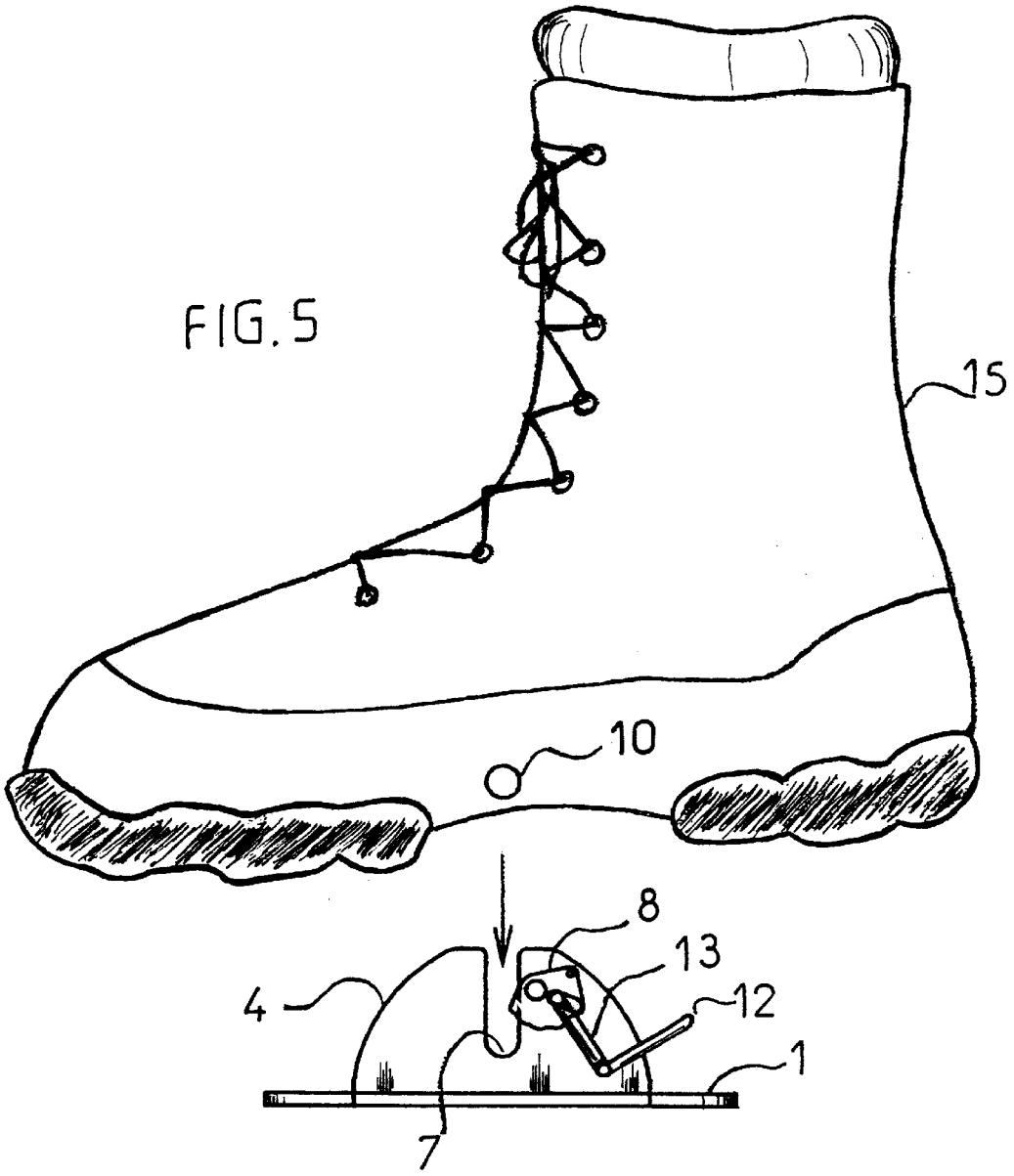

FIG. 5 elucidates the operation of the booting device. The boot 15 need not be positioned longitudinally or in horizontally sideways manner to implement engagement. Even though they are linked by the rod 13 through the slit 16, the cams 8 and 9 are independent.

The design is such that the booting device is operational regardless of the boot's orientation.

The booting device of the invention may be made of a lightweight metal, for instance of sheetmetal, or of an aluminum alloy, or of a plastic of suitable strength.

Only the upper sole has been shown in the Figures because the boot'supper and the ankle part can take may forms without affecting the invention.

FIGS. 8 and 9 show that a sole 21 of a boot of the invention comprises a front part 23 and a rear part 22 called heel. An indentation 4 is situated between the two pails 22 and 23 and in the described embodiment assumes a circular shape with a diameter of 110 mm and a depth of 14 mm. These shapes and dimensions are merely illustrative. The indentation is arbitrary in its shape and illustratively may be square, rectangular, elliptic, oval etc. to allow fastening a bar 25 between the front part 3 and the heel 2. The length of this bar running transversely to the sole's length is slightly larger than the width of the sole to create thereby projecting hook-up elements or elements substantially aligned with the external shapes of the boot's ankle part.

The bar 5 is designed to engage a device (shown in FIGS. 1 through 7) on the booting device of the invention (i.e. transverse bar 10 in FIG. 1) in order to cooperate with the boot. The position of the bar 25 is substantially offset from the center of the sole and toward the rear, that is toward the heel 22. The purpose of this bar position is to better position the user to implement more direct force transmission.

The bar 25 is kept by any known means against the sole. In the described embodiment, it is kept in place by a plate 26 affixed by four screws 27. The boot's sole 27 also may comprise a groove 29 to better hold the bar 25 in place. Only the boot's sole has been shown in the Figures because the boot's upper and the ankle part can take may forms without affecting the invention.

In some embodiments the bar 25 comprises elbows at its two ends projecting beyond the sole in order to be higher.

The invention is not restricted to the above defined embodiments but on the contrary comprises all variations introduced by the expert regarding dimensions, shapes and positions of reinforcements and of the bar 5.

It speaks for itself that the invention is not limited to the above single illustrative embodiment of this automatic board booting-device but does include all embodiment variations, in particular regarding the shape of the rest plates of the foundation or the implementing material.

I claim:

1. Automatic booting device for snow surfboards comprising a foundation, to be affixed to a snowboard, wherein the foundation (1) is fitted with two plates vertically fastened to its long sides (3, 4) comprising slots (6, 7) entered by an elongated element to be fastened to a boot, and in that it comprises means to keep said element in the slots (6,7) in a closed position while releasing said element in an open position, said means comprises two independent cams affixed to shafts firmly and pivotally mounted to the vertical plates and means for resiliency holding said cams in the closed position, said cams pivoting independently of each other.

2. Board booting device as claimed in claim 1, wherein the cams are shaped in such manner that the elongated element is biased into the groove in the closed position, allowing automatic repositioning of said cams when a force is applied to the cams through the elongated element.

3. Board booting device as claimed in claim 1, wherein the foundation and the plates are made from a material consisting of one of steel, aluminum alloy, and plastic.

4. A snowboard boot comprising an upper and a sole for a booting device as claimed in claim 1, wherein the sole comprises an indentation situated between a front part and a heel and within which is located an elongated element or bar of which the ends shall engage the cams provided for that purpose on the booting device, said bar running transversely to the length of the sole and being substantially offset from the center of the sole toward the heel.

5. Boot as claimed in claim 4, wherein the bar offset is between 1 mm and 30 mm, the indentation being circular with a diameter between 100 mm and 120 mm and the depth being between 8 mm and 22 mm.

6. Boot as claimed in claim 5, wherein the bar offset is about 20 mm, the indentation has a diameter of about 110 mm and the depth is about 14 mm.

7. Automatic booting device for snow surfboards, said device comprising:

a substantially oblong foundation affixed to a snowboard, two plates vertically fastened to long sides (3, 4) on said foundation, said plates respectively comprising slots (6, 7) entered by an elongated element to be fastened to a boot, and means to keep said element in the slots (6,7) in a closed position while releasing said element in an open position, said means comprises two independent cams pivotally mounted to shafts disposed on the vertical plates, said cams pivoting independently of each other and having means to resiliently hold said cams in the closed position, wherein the cams are shaped in such manner that the elongated element is biased into the groove in the closed position, allowing automatic adjustment when a force is applied to the cam through the elongated element.

8. Board booting device as claimed in claim 7, wherein the foundation and the plates are made from a material consisting of one of steel aluminum alloy, and plastic.

9. A snowboard boot comprising an upper and a sole for a booting device as claimed in claim 8, wherein the sole comprises an indentation situated between a front part and a heel and within which is located an elongated element or bar of which the ends shall engage the cams provided for that purpose on the booting device, said bar running transversely to the length of the sole and being substantially offset from the center of the sole toward the heel.

10. Boot as claimed in claim 9, wherein the bar offset is between 1 mm and 30 mm, the indentation being circular with a diameter between 100 mm and 120 mm, and the depth being between 8 mm and 22 mm.

* * * * *